US007184254B2

(12) United States Patent
Dimanstein

(10) Patent No.: US 7,184,254 B2
(45) Date of Patent: Feb. 27, 2007

(54) APPARATUS AND METHOD FOR CONTROLLING THE MAXIMUM STROKE FOR LINEAR COMPRESSORS

(75) Inventor: Isaac Dimanstein, Carrara (AU)

(73) Assignee: Airxcel, Inc., Wichita, KS (US)

( * ) Notice: Subject to any disclaimer, the term of this patent is extended or adjusted under 35 U.S.C. 154(b) by 574 days.

(21) Appl. No.: 10/155,342

(22) Filed: May 24, 2002

(65) Prior Publication Data

US 2003/0218854 A1 Nov. 27, 2003

(51) Int. Cl.
*H01H 47/28* (2006.01)

(52) U.S. Cl. ..... 361/187; 361/600; 417/45; 318/687

(58) Field of Classification Search ..... 361/187, 361/24, 600, 601; 62/6, 228, 520; 417/45; 323/284; 318/686, 687, 135
See application file for complete search history.

(56) References Cited

U.S. PATENT DOCUMENTS 3,562,585 A * 2/1971 Gourdine ..... 361/4
4,067,667 A * 1/1978 White ..... 417/418
5,342,176 A 8/1994 Redlich ..... 417/212
5,752,811 A * 5/1998 Petro ..... 417/416
6,015,270 A * 1/2000 Roth ..... 417/259
6,084,320 A 7/2000 Morita et al. ..... 310/12
6,199,381 B1 * 3/2001 Unger et al. ..... 60/520
6,204,652 B1 3/2001 Albou et al. ..... 323/284
6,289,680 B1 9/2001 Oh et al. ..... 62/6

FOREIGN PATENT DOCUMENTS

WO WO 00/16482 3/2000

* cited by examiner

*Primary Examiner*—Angel R. Estrada
(74) *Attorney, Agent, or Firm*—Hovey Williams LLP

(57) ABSTRACT

An apparatus and method for controlling the maximum stroke of a linear compressor is provided. The shorting of the normal supply voltage of a compressor to ground is used to detect overstroking. A plurality of transistors are electrically coupled to the control circuit that is electrically coupled to a linear compressor. When the compressor's stroke exceeds it maximum stroke marked by the refrigerant barrel of the compressor making physical contact with the armature, a signal is received by the control circuit. The control circuit processes this signal and sequences the transistors to return the extended stroke of the compressor to its maximum stroke.

22 Claims, 5 Drawing Sheets

PISTON MOVEMENT
AWAY FROM VALVE-
PLATE

COMPRESSOR
DRIVE VOLTAGE

FIG. 7.
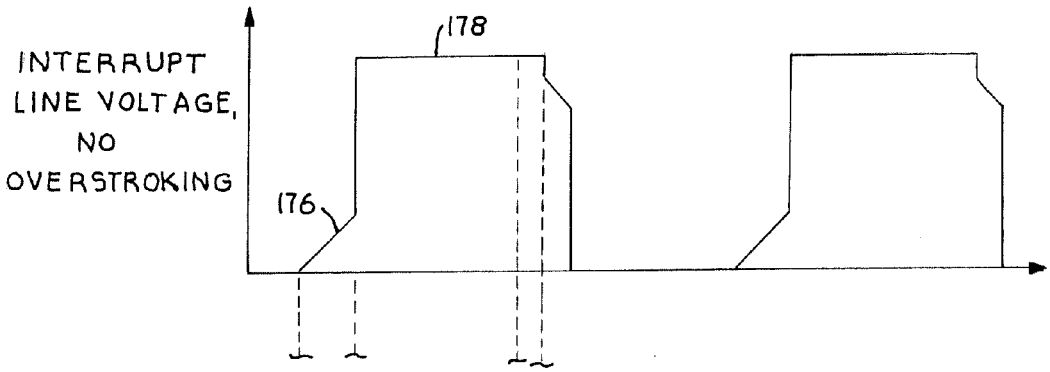
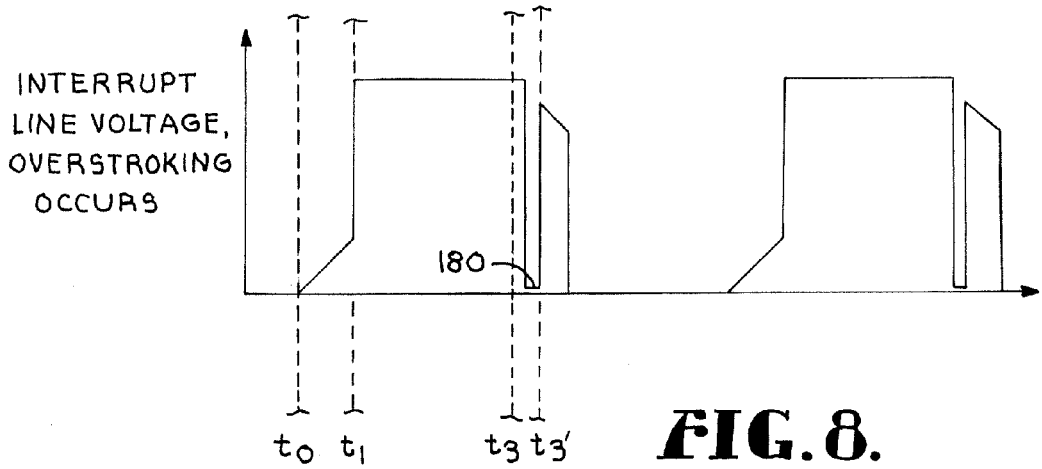
FIG. 8.

APPARATUS AND METHOD FOR CONTROLLING THE MAXIMUM STROKE FOR LINEAR COMPRESSORS

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

This invention relates to linear electrical compressors and, more particularly, to a method and apparatus for controlling the operation of a linear compressor to maximize the stroke amplitude of the same.

BACKGROUND OF THE INVENTION

In a typical reciprocating compressor, a rotary motor is coupled to a crankshaft that restricts the piston's minimum and maximum displacement. Linear compressors, on the other hand, lack a crankshaft and the piston is driven directly by a linear motor. As a result, linear compressors generally operate more efficiently because the frictional losses resulting from use of a crankshaft are eliminated. Linear compressors are currently used in compression refrigeration systems and a variety of other applications.

When used as part of a compression refrigeration system, linear compressors typically use a linear oscillating driver, which includes an armature mounted between two springs, that drives a piston attached to the armature. The piston reciprocates axially within a barrel and, during a compression stroke, refrigerant is compressed by the piston within the barrel and is discharged through a discharge valve once a preselected compression pressure is reached. The piston then reverses direction during the suction stroke and refrigerant is drawn through a suction valve into the barrel. The compression and suction strokes are repeated at a preselected frequency.

A linear compressor's efficiency is related to the stroke length of the piston. The larger the stroke length, the more refrigerant that can be drawn into and compressed within the barrel during each cycle. A maximum stroke length is thus desirable in order to maximize the compressor efficiency. The absence of a crankshaft to control the maximum displacement of the piston, however, makes it difficult to reliably maintain the maximum stroke length in linear compressors. If the piston travels too far, or "overstrokes", it can strike the valves or other parts of the barrel assembly during the compression stroke, causing objectionable noise and damage to the valves, pistons or other parts of the compressor over time.

Although it has been suggested that various types of position sensors could be used to detect piston position within the compressor, the use of such sensors has been said to create installation problems by requiring the routing of wires through the walls of the pressurized compressor. An alternative method to detecting and controlling piston position is disclosed in U.S. Pat. No. 5,342,176. The method disclosed in that patent estimates piston position at closest approach to the cylinder head using measurements of motor voltage and current obtained outside the compressor. Those voltage and current measurements are then input to a digital or analog computation device which calculates piston position based on known linear motor properties and known dynamics of piston motion. Because the calculated piston position is subject to errors based on variations in refrigerant system conditions, a need exists for a method to more accurately detect and control overstroking of a linear compressor.

SUMMARY OF THE INVENTION

The present invention is directed to a method and apparatus for controlling the maximum desired stroke of a linear compressor by using an interrupt circuit that shorts the normal supply voltage of the compressor to ground when the piston overstrokes.

In one aspect of the present invention, there is provided a single-ended linear refrigerant compressor, a plurality of switches such as metal oxide silicon field effect transistors (MOSFETs) that are electrically coupled to a control circuit that in turn controls the frequency and amplitude of the armature's oscillations. Upon receipt of an interrupt signal caused by overstroking of the piston, the control circuit reduces power to the compressor in an attempt to rectify the piston overstroking.

In another aspect of the present invention, there is provided a double-ended linear refrigerant compressor that has two motors, each with a plurality of switches electrically coupled to a control circuit that in turn controls the amplitude of the armature's oscillations.

The piston of the compressor is rigidly attached to and moves with the armature. The control circuit is electrically coupled to the compressor to also receive an interrupt signal if the refrigeration barrel of the compressor comes into physical contact with the armature. The refrigerant barrel is attached to a barrel housing is rigidly attached to the compressor housing. When the control circuit receives the interrupt signal, it reduces power to the driver circuit by a preselected amount in an attempt to return the maximum stroke of the linear compressor to its maximum desired stroke.

BRIEF DESCRIPTION OF THE DRAWINGS

The present invention is described in detail below with reference to the attached drawing figures, wherein:

FIG. 7 is a graph of the signal delivered to the control circuit in normal operation;

FIG. 8 is a graph of the signal delivered to the control circuit when the piston approaches the valve too closely.

DETAILED DESCRIPTION OF THE INVENTION

Figure 1:
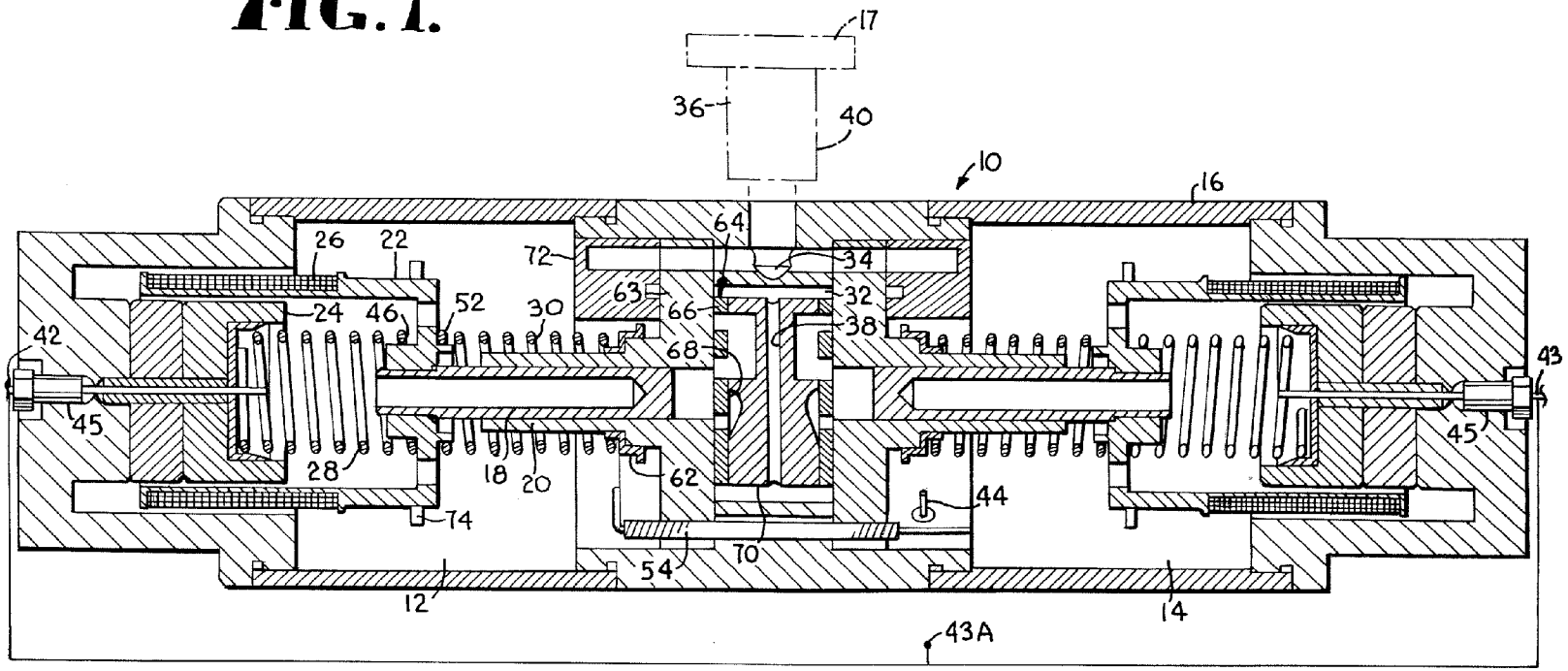
FIG. 1 is a side elevation view, taken in vertical section, of the linear compressor.
Figure 2:
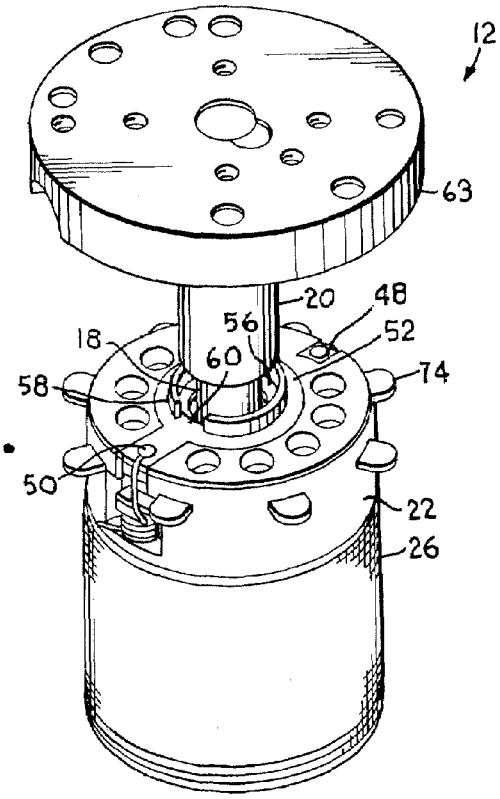
FIG. 2 is an enlarged perspective view of an armature and barrel of the linear compressor constructed in accordance with the present invention.

Referring now to the drawings in greater detail, and initially to FIGS. 1 and 2, a double-ended compressor assembly is represented generally by the numeral 10. Compressor assembly 10 comprises two linear compressors 12 and 14 that are substantially identical to each other and are mounted along a common axis within an exterior housing 16. The linear compressors 12 and 14 work in tandem and operate to compress a refrigerant fluid which is used in a known manner to effect heat transfer within an overall refrigerant system 17, the details of which are not shown because of their conventional nature.

Each compressor 12 and 14 comprises an elongated piston 18 that reciprocates along its longitudinal axis within a fixed cylindrical barrel 20. The piston is mounted to and extends axially from a closed end of an armature 22. An opposite end of the armature 22 is open and surrounds a magnetic core 24 which generates a magnetic field. Windings 26 are provided on the armature 22 and, when energized by an electrical current, create a magnetic field that interacts with the magnetic field of core 24 to cause axial movement of the armature 22.

An internal spring 28 is provided within the hollow armature 22 and exerts a biasing force urging axial movement of the armature 22 in a first direction to cause increasing extension of piston 18 within barrel 20. An opposite-acting external spring 30 surrounds the barrel 20 and engages the armature 22 to exert a biasing force on the armature 22 in a second, opposite direction causing retraction of piston 18 within barrel 20. Because the external spring 30 becomes compressed as the internal spring 28 expands, and vice-versa, the resonating springs 28 and 30 facilitate axially oscillating movement of the armature 22 when current is supplied to the armature windings 26. The oscillation of the armature 22, in turn, causes oscillating or reciprocating movement of piston 18 within the barrel 20.

The compressors 12 and 14 are preferably mounted in facing relationship within the housing 16 so that the compressor pistons 18 extend toward each other and retract away from each other. Both barrels 20 are in fluid flow communication with a center chamber 32 that has an inlet port 34 to permit refrigerant to enter the chamber 32 from an inlet line 36 as a result of the vacuum created during retraction of pistons 18 within barrels 20. The refrigerant is also drawn into the barrels 20 and is compressed as the pistons 18 reverse direction during their compression stroke. The compressed refrigerant is discharged from the chamber 32 through a discharge port 38 and then travels through an outlet line 40 for use in effecting heat transfer in the refrigerant system 17.

Current is supplied to the windings 26 of the armatures 22 by way of electrical terminals 42 and 43 provided at opposite ends of the housing 16 and a middle terminal 44 which is in electrical communication with the end terminals 42 and 43. A lead 45 connects each terminal 42 and 43 to one end of the internal spring 28 in each compressor 12 and 14. The opposite end of each internal spring 28 contacts a conductive ring 46 positioned internally at the closed end of the armature 22. An internal tab 48 extends from the internal ring 46 to one end of the armature windings 26. The opposite end of the windings 26 is connected to an external tab 50 which is joined to a second ring 52 positioned externally at the closed end of the armature 22. The external ring 52 is positioned to contact one end of the external spring 30, while the opposite end of each external spring 30 is connected to a jumper 54 which places the springs 30 in electrical contact with each other. The jumper 54 also places the springs 30 in contact with the middle terminal 44 to complete the pathway for current to flow in either direction between end terminals 42 and 43 and the middle terminal 44. Together, the end terminals 42 and 43, internal springs 28, windings 26, external springs 30, middle terminal 44 and their various connectors form part of an electrical driver circuit 55 (see FIG. 3) that controls operation of the two compressors 12 and 14.

Each piston 18 is normally isolated from the driver circuit 55 by mounting the piston 18 in a polymeric or other nonconducting material and forming an annular space 56 between the piston and the external ring 52. A nonconducting annular flange 58 surrounds the annular space 56 and forms a seat for the external ring 52 and the rearward end of the external spring 30. An inner diameter of the annular flange 58 is slightly greater than the outer diameter of the barrel 20 to permit entry of the barrel into the annular space 56. An interrupt contact 60 is positioned within the annular space 56 at a location where it engages the free end of the barrel 20 when the piston 18 exceeds its maximum desired stroke length. The interrupt contact 60 is in electrical communication with the external ring 52 and the driver circuit 55, and may be formed by extending the external tab 50 through a cutout in the annular flange 58.

Under normal operating conditions, each barrel 20 is isolated from the driver circuit 55. To physically and electrically isolate the barrel 20 from the surrounding conductive external spring 30, the spring 30 is wound with a diameter greater than the outer diameter of the barrel 20. A nonconducting polymeric washer 62 is provided on the barrel 20 and seats against the forward end of the external spring 30 to further isolate the spring 30 from the barrel 20.

Both barrels 20 also have a flange 63 positioned at a forward end which is press fit or otherwise fixed about its outer perimeter to the inner surface of housing 16. The flange 63 serves to fix the barrel 20 in place and to place the barrels in electrical communication with the housing 16 to create a short in the driver circuit 55 when the end of one or both barrels 20 engages the interrupt contact 60. A multipiece valve plate 64 is secured to a forward face of the barrel flange 63 and includes a suction valve 66 and discharge valve 68, the details of which are not shown because of their conventional nature, to control passage of the refrigerant through internal passageways (not shown) to and from the internal chamber within the barrel 20. A muffler 70 is secured to a forward face of the valve plate 64 within the refrigerant chamber 32 and contains internal chambers and passageways constructed to allow passage of the refrigerant while dampening the noise generated during operation of the compressors 12 and 14. An oil guard 72 is positioned on an opposite face of the barrel flange 63 and contains tortuous internal passages that separate entrained lubricating oil from the refrigerant flow. A plurality of radially extending oil slingers 74 are also provided on the external surface of the armature 22 to provide more uniform lubricating oil distribution within the compressors 12 and 14.

Figure 3:
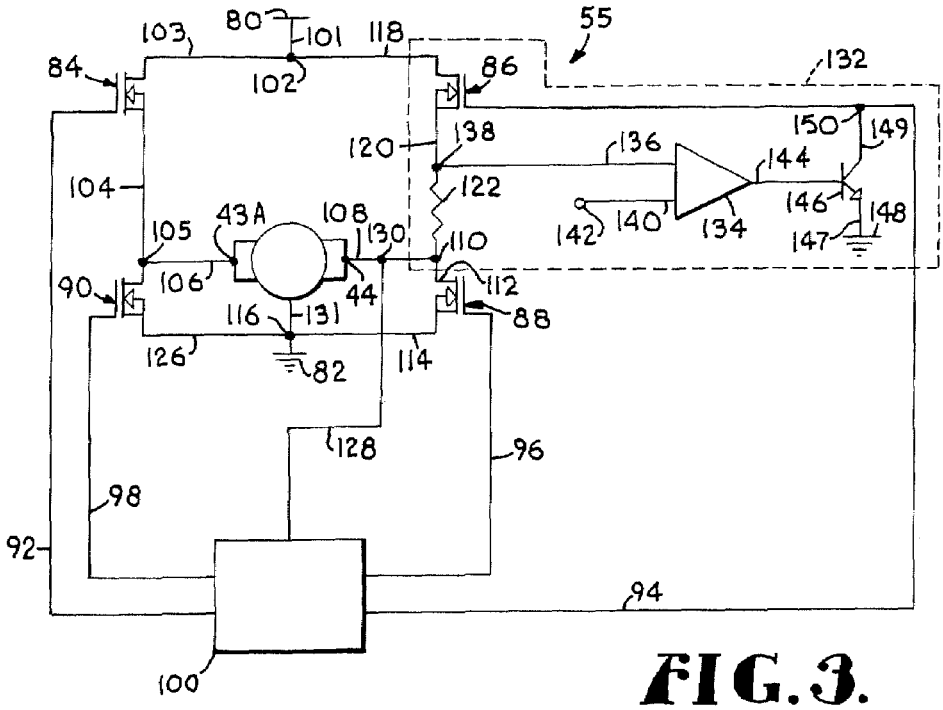
FIG. 3 is a simplified schematic diagram of an electrical driver for a linear compressor according to one embodiment of the invention.

Turning additionally to FIG. 3, constant voltage is provided across the electrical driver circuit 55 from a source 80 to a ground 82. Four electrical switches 84, 86, 88 and 90 are provided in the driver circuit and are connected by electrical gate conductors 92, 94, 96 and 98 to a control circuit 100. The control circuit 100 turns the switches 84, 86, 88 and 90 on and off in a regulated manner to control current flow through the driver circuit 55, thereby controlling operation of the compressors 12 and 14. The control circuit 100 is provided with a microcontroller that has an analog-to-digital converter that senses analog voltage and converts it to digital data that can be processed by the microcontroller in a manner known to those of ordinary skill in the art.

Each of the switches 84, 86, 88 and 90 is operable such that it is turned on when voltage is applied to a gate of the switch and is turned off in the absence of voltage applied to the gate. This function can be performed, for example, by a transistor and preferably a metal oxide silicon field effect transistor comprising a drain, a source and a gate and commonly known as a MOSFET. Current flows from the drain to the source when a voltage is applied to the gate, thereby closing or turning on the switch. In the absence of voltage, the switch opens or is turned off, thereby creating an open circuit.

In a first path, during a suction cycle, current is delivered to the windings 26 of the compressor armatures 22 by way of an input line 101 that connects the voltage source 80 to a junction 102 and a conductor 103 that connects the junction 102 to the drain of switch 84. A conductor 104 then connects the source of switch 84 to another junction 105, and a lead 106 connects the junction 105 to the end terminals 42 and 43. Terminals 42 and 43 are in electrical connection with each other by a conductor having a junction 43A. Current then travels from the terminals 42 and 43 through the internal springs 28, armatures 22 and external springs 30 to middle terminal 44. The current then travels from the middle terminal 44 through a lead 108 to a junction 110, then through a conductor 112 from the junction 110 to the drain of paired switch 88, and then from the source of switch 88 through another conductor 114 to a junction 116 and then to ground 82. For current to flow along this path, the paired switches 84 and 88 are turned on and the paired switches 86 and 90 are turned off by action of the control circuit 100 applying a voltage across gate conductors 92 and 96, respectively, to the gates of the switches 84 and 88.

In a similar manner, current is delivered to the armature windings 26 along a second path, during a compression cycle, by an electrical conductor 118 that connects the junction 100 from voltage source 80 to the drain of switch 86. The source of switch 86 is then connected by a conductor 120 through a sense resistor 122 to junction 110, with the current then flowing through lead 108 to compressor middle terminal 44. The current flows through the external springs 30, armature windings 26 and internal springs 28 to the end terminals 42 and 43. The current then flows from end terminals 42 and 43 through lead 106 to junction 105, and then through a conductor 124 to the drain of switch 90. The current path is completed by a conductor 126 leading from the source of switch 90 to ground junction 116 and then to ground 82. In order for current to flow along this second path, the control circuit 100 applies a voltage through gate conductors 94 and 98 to turn on the paired switches 86 and 90 while the paired switches 84 and 88 are turned off by removing the voltage from the gates of those switches.

Thus during a suction cycle, terminals 42 and 43 are energized by source voltage 80 and terminal 44 is grounded because switches 84 and 88 are turned on an switches 86 and 90 are turned off. During a compression cycle, terminal 44 is energized by source voltage 80 and terminals 42 and 43 are grounded because switches 86 and 90 are turned on and switches 84 and 88 are turned off. The sequencing of switches 84, 86, 88, and 90 will be explained in greater detail below.

As can be readily appreciated by those of ordinary skill in the art, the control circuit 100 turns the switches 84, 86, 88 and 90 on and off in sequence and at a preselected, variable frequency to cause current to flow sequentially along the first and second paths. When current flows along the first path, the polarity of the magnetic field created within the armature windings 26 urges movement of the compressor armatures 22 and pistons 18 away from the centrally positioned valve plates 64. When the current flow is sequenced to flow along the second path, the polarity of the armature magnetic field is reversed and the armatures 22 and pistons 18 are urged toward the valve plates 64.

In accordance with the present invention, in order to detect and prevent continued overstroking of the pistons 18, the driver circuit 55 includes an interrupt lead 128 that connects the control circuit 100 to the compressor lead 108 by way of a junction 130. When one or both pistons 18 exceeds its maximum desired stroke length, the end of the associated barrel 20 contacts the interrupt contact 60 carried by the armature 22, causing a short of the supply voltage 80 to the compressor housing 16. The housing 16, in turn, is connected to ground 82 by a lead 131 that connects to ground junction 116. The short of the supply voltage 80 to ground 82 reduces the otherwise high voltage level on the interrupt lead 128. The control circuit 100 detects this reduction in voltage level and reduces or shuts off power to the driver circuit 55 in a manner to be more fully described below.

The driver circuit 55 also includes a current limiting circuit 132 that opens the driver circuit 55 when current above a predetermined level begins to flow through the driver circuit, such as may result from the shorting that occurs when one or both pistons 18 overstroke. The current limiting circuit 132 includes the sense resistor 122 and a comparator 134 that has one input lead 136 connected to conductor 120 by way of junction 138 and another input lead 140 that is connected to a reference voltage source 142. An output lead 144 from the comparator 134 is connector to an electrical switch such as transistor 146 which operates as a switch with one end 147 connected to ground 148 and another end 149 connected to gate conductor 94 by way of junction 150. If an excessive amount of current begins to flow through sense resistor 122, then a high voltage level will begin to develop on comparator 134 input lead 136. If the voltage level on the input lead 136 exceeds the preselected reference voltage on lead 140, then the comparator 134 sends a signal through the output lead 144 to turn on the transistor 146. When the transistor 146 is turned on, current flowing from the control circuit 100 through gate conductor 94 shorts to ground 148 through junction 150, thereby reducing voltage on the gate of switch 86 and causing switch 86 to open. The open switch 86 clamps the high current that would otherwise flow through the driver circuit 55.

Figure 4:
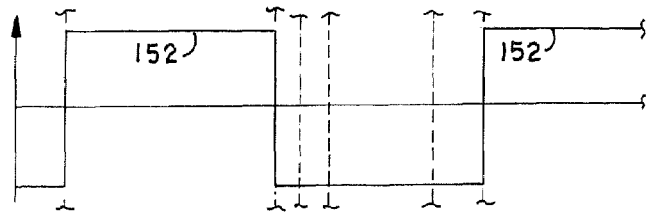
FIG. 4 is an armature movement graph where positive segments represent movement towards the valve and negative segments represent movement away from the valve.
Figure 5:
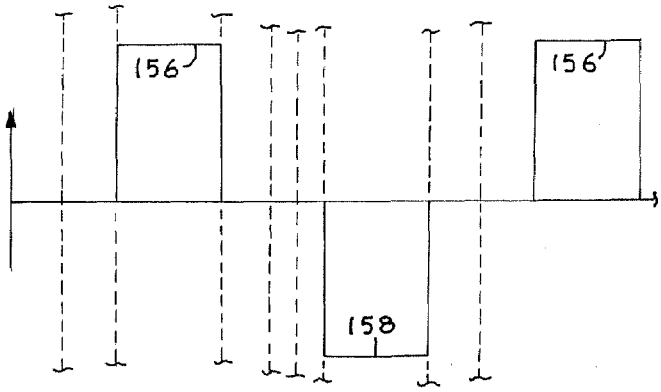
FIG. 5 is a graph of a voltage waveform delivered to the armature of the compressor.
Figure 6A:
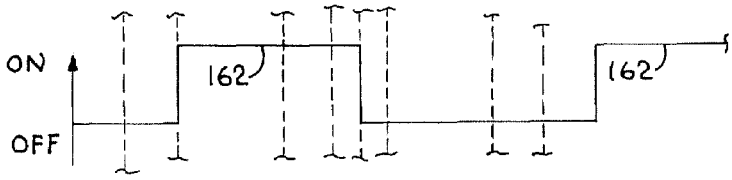
FIGS. 6A through 6D are graphs of voltage waveforms respectively depicting whether switches 84, 86, 88, and 90 are turned on or off in response to signals distributed from the control circuit that correspond to the armature movement and armature voltage as depicted in FIG. 4 and FIG. 5.
Figure 6B:
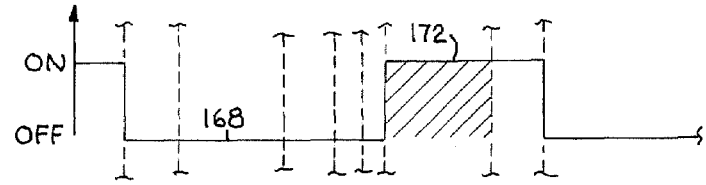
Figure 6C:
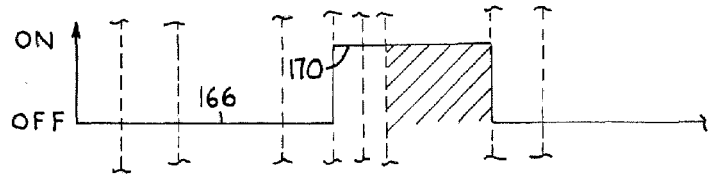
Figure 6D:
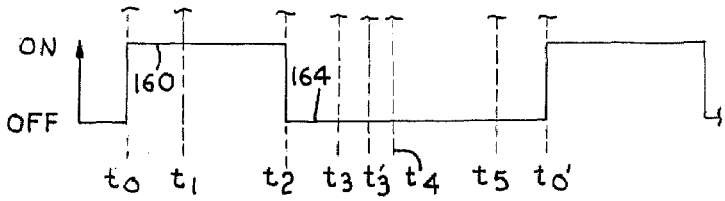

FIGS. 4–6 together illustrate how the movement of piston 18 coincides with the voltage levels induced in the armature windings 26 and the on-off sequencing of switches 84, 86, 88 and 90. At time $t_0$, the compression cycle, which is designated by the numeral 152 in FIG. 4, is initiated as the compressed interior springs 28 and extended exterior springs 30 begin moving the pistons 18 toward the valve plates 64 from their fully retracted positions. As the pistons 18 travel toward the valve plates 64, the refrigerant is compressed within the barrels 20 until time $t_3$, when the pistons 18 reach the limit of their compression stroke and a suction cycle 154 is initiated. During the suction cycle, the pistons 18 reverse direction under the influence of the now compressed exterior springs 30 and extended interior springs 28 and travel away from the valve plates 64 to create a vacuum which draws refrigerant into the barrels 20. The pistons 18 reach the end of their suction stroke at $t_0'$ and again reverse direction to initiate the next compression cycle 152. The pistons 18 continue to alternate between the compression and suction cycles 152 and 154 at a frequency defined by the resonance of springs 28 and 30 and armature mass and matched by control circuit 100.

As can be seen in FIG. 5, voltage induced by the driver circuit 55 across the armature windings 26 produces a current flow that creates a magnetic field within the armature windings 26. This armature magnetic field interacts with the stationary magnetic field produced by magnet core 24 to create a force that urges movement of the pistons 18 in the existing direction of travel. For example, during the compression cycle, a first directional voltage level designated by the numeral 156 in FIG. 5 creates a force that urges the pistons 18 toward the valve plates 64. This first voltage level 156, however, is only applied between times $t_1$ and $t_2$, which represents only a portion of the compression stroke of pistons 18. During the balance of the compression stroke, the pistons 18 are moving under the influence of their own inertia and the forces of springs 28 and 30. Similar, during the suction cycle 154, a second voltage level 158, equal in magnitude and opposite in direction to the first voltage level 156, is induced to create an opposite current flow through the armature windings 26 between times $t_4$ and $t_5$. This opposite current flow creates a reverse magnetic field that assists in drawing the pistons 18 away from the valve plates 64 during only a portion of the suction cycle. During the balance of the suction cycle, the pistons 18 are moving as a result of their inertia and the forces of springs 28 and 30.

Turning now to FIGS. 6A–D, the on and off sequencing of switches 84, 86, 88 and 90 by control circuit 100 is illustrated. Control circuit 100 opens and closes switches 84, 86, 88 and 90 to control the frequency of the driver circuit 55. In a preferred embodiment, a compression cycle 152 starts at time $t_0$ with switch 90 on, indicated by numeral 160. At time $t_1$, paired switch 86 is brought into the on position 162, energizing the armature windings 26. Voltage source 80 ceases to supply voltage to the armature windings 26 at time $t_2$ when switch 90 is toggled to the off position 164. Although switch 90 is opened at time $t_2$, paired switch 86 remains on 162 until time $t_3'$ as will be explained in greater detail below. Until time $t_3$, switch 84 is in the off position 166 and switch 88 is in the off position 168. At time $t_3$, switch 84 is toggled to the on position 172. Switch 88 is toggled to the on position at time $t_4$, energizing the armature windings 26 during the suction cycle.

During the compression cycle 120, voltage is supplied to terminal 44 by source 80 as long as switch 86 is in the on position 162. That is, when switch 86 is in the on position 162, a continuity path exists from source 80 to terminal 44, which is in electrical communication with interrupt line 128 and the end of exterior springs 30 near the valve plates 64. Just prior to pistons 18 striking valve plates 64, barrels 20, which are electrically connected to ground 82, will strike exterior ring 52. Exterior ring 52 is in electrical contact with external spring 30. Accordingly, voltage supplied by source 80 to terminal 44 is shorted through external springs 30 and external rings 52 to grounded barrels 20. This short causes the control circuit 100 to receive a low signal via interrupt line 128.

The control circuit 100 is programmed to expect a high signal on interrupt line 128 from time $t_2$ until $t_3'$ during normal operation. Extending the time to detect overstroking until time $t_3'$ permits the control circuit 100 to function in situations where the driver 55 frequency is slightly different from the resonant frequency of the compressors 12 and 14. For example, although the pistons 18 should reverse direction by time $t_3$, if one or both pistons 18 overstrokes after time $t_3$, the impending overstroking condition will be detected.

Driving the compressors at their resonant frequency allows the compressors to operate more efficiently. Compressors 12 and 14 can oscillate at the same frequency of the driver circuit 55, which corresponds to the natural frequency of compressors 12 and 14. One cycle of driver circuit 55 spans from time $t_0$ to $t_0'$. If the driver circuit 55 is not synchronized with the frequency of the compressors 12 and 14, then control circuit 100 will resynchronize the two frequencies by monitoring the back electromotive force (back EMF) level on the drain of switch 88 created as the armature windings 26 move through the magnetic field of magnetic core 24. This back EMF that can be observed and measured at various reference points of the driver circuit 55 and at various times within a driver circuit 55 cycle. The drain of switch 88 is a preferred reference point and time $t_0$ is a preferred time to sample the back EMF level.

In normal operation, the start of a compression or expansion cycle coincides with the start of a new driver circuit 55 cycle. The control circuit 100 monitors when a new compressor cycle, or half-cycle, is about to begin. Half-cycles span from time $t_0$ to $t_2$ and from $t_2'$ to $t_0'$ and begin every time the pistons 18 change direction. As discussed earlier, the level of back EMF induced at the drain of switch 88 is proportional to the velocity of the armatures 26. Just before the pistons 18 change direction, the velocity of each, along with the induced back EMF, drops to zero.

The control circuit 100 functions to take corrective action to synchronize the start of a new driver cycle with the start of a compression cycle. Turning now to FIG. 7, time $t_0$ marks the beginning of a compression cycle. Switch 86 is off, as designated by numeral 162, at the start of the compression cycle thereby preventing any energizing current from source 80 to flow to the drain of switch 88 and produce a voltage level at junction 110. The interrupt line 128 is in electrical connection with junction 110 and will maintain the same voltage level as the drain of switch 88. At time $t_0$ the driver 100 will normally begin a new cycle. With no source voltage available to create an energizing voltage on interrupt line 128, only a possible voltage ramp 176 produced by back EMF will be sensed during the period from $t_0$ to $t_1$. The control circuit 100 uses interrupt line 128 to measure the polarity and magnitude of the back EMF 176 present at time $t_0$ to determine whether the frequency of the driver circuit needs to be modified.

In a preferred embodiment, the sampled induced EMF is zero volts at the drain of switch 88 at time $t_0$, as indicated in FIG. 7. That is, the control circuit 100 will start a new cycle at $t_0$ just as the armature 22 reverses direction from moving away from valve plates 64 to moving towards valve plates 64. If the control circuit 100 measures the voltage level 176 on the drain of switch 88 to be positive, then control circuit 100 switched the state of the driver circuit 55 too late. The armature is moving ahead of the driver circuit 55 and switch 90 was turned on too late. The measured positive polarity indicates that the armature 22 is moving in a direction towards the valve plates 64 at time $t_0$. The armature has advanced more than is desirable and the windings 26 have begun moving into the magnetic field of core 24 prematurely, thereby producing the observed positive voltage. Because the driver circuit switched states too late, its frequency is lower than the resonant frequency of the compressors 12 and 14 and the control circuit 100 will increase the frequency of the driver circuit 55.

In contrast, if the control circuit senses a negative back EMF at $t_0$ then the armature is moving in the wrong direction. The armature is, for instance, continuing to move away from the valve plates 64 when it should have passed its point of inflection and begun returning in a direction of motion towards the valve plates 64. Thus, the driver circuit's state was switched too early and the driver 55 frequency is higher than the natural frequency of compressors 12 and 14. The control circuit 100 will consequently reduce the driver frequency.

As shown in FIG. 7 and FIG. 8, if the control circuit measures and finds no voltage produced by back EMF 176 at time $t_0$, then no corrective action is taken because the driver 55 frequency is synchronized with the natural frequency of the compressors 12 and 14. The magnitude of the back EMF 176 is indicative of the degree that the operating frequency is out of sync with its resonant frequency. Thus, the control circuit 100 may allow for a small amount power generated by back EMF before taking corrective action. For example, a plus or minus 300 mv deviation may be acceptable before altering the driving frequency.

FIG. 7 further depicts normal compressor 10 operation where no overstroking is present whereas FIG. 8 depicts the voltage level present on the interrupt line 128 when overstroking occurs. Overstroking occurs in FIG. 8 between times $t_3$ and $t_3'$ and generates a low signal, indicated by reference numeral 180. The control circuit is programmed to expect the high signal 178 to remain high until time $t_3'$, which is when switch 86 is toggled to the off position 162. While switch 86 is left on, a voltage level 178 from the supply voltage 80 will be present at the interrupt line 128. Just before the pistons 18 strike valve plates 64, the barrels 20 will strike the exterior ring 52, shorting the supply voltage 80 to ground 82. This short creates low signal 180 on the interrupt line 128. In the forgoing example, the overstroking 180 occurred between time $t_3$ and $t_3'$ but was still detectable because switch 86 remained in the on position 162 until time $t_3'$ and because the control circuit 100 was programmed to expect a high signal 178 until time $t_3'$. The preferred embodiment of the driver circuit 100 can detect overstroking under less than ideal conditions where irregular pressures, refrigerant levels, or circuit operating conditions can interfere with the compressor's normal operation. When overstroking is detected, a process illustrated in FIG. 9 attempts to correct the problem.

Figure 9:
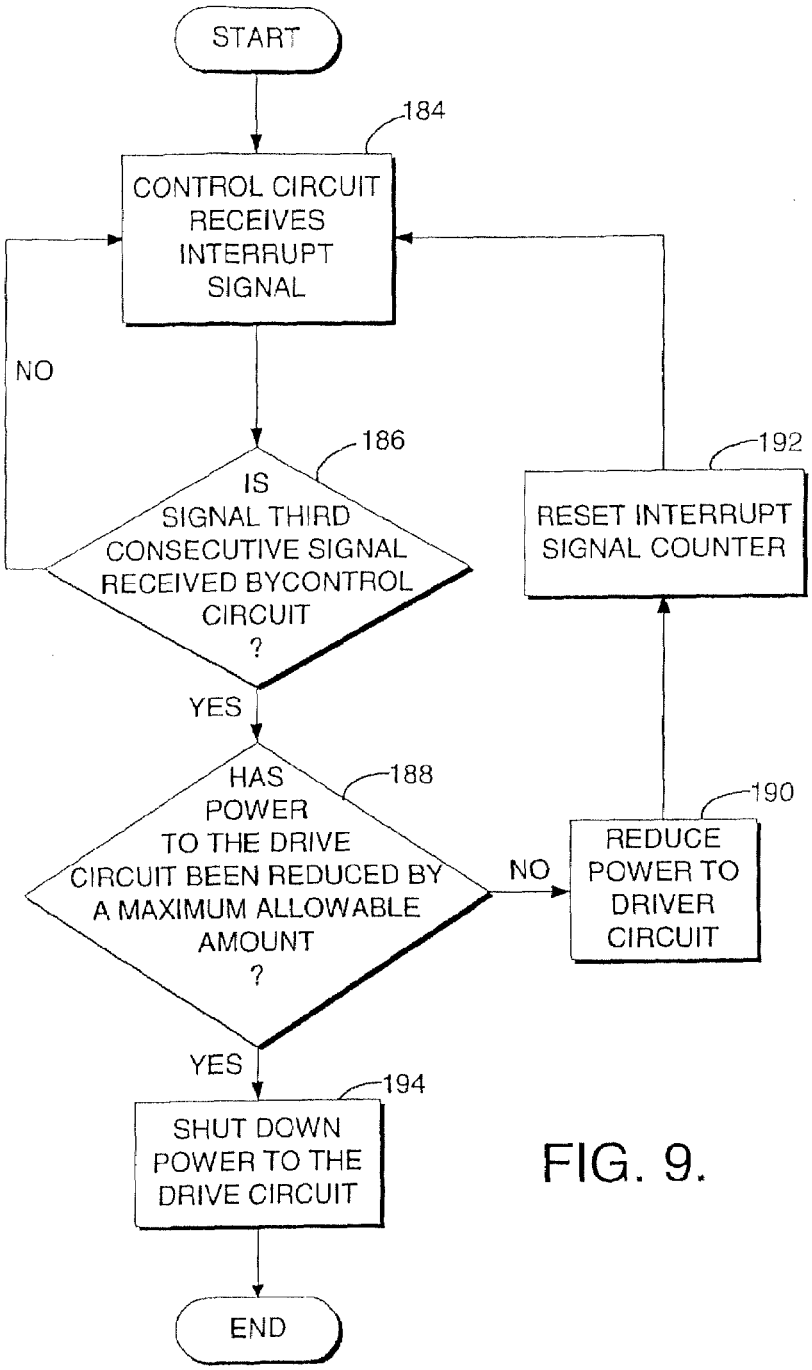
FIG. 9 is a flowchart illustrating how the control circuit prevents continued overstroking.

Turning now to FIG. 9, the process of correcting overstroking begins at an initial step 184 when the control circuit 100 receives a low signal 180 from interrupt line 128. At a step 186, the control circuit 100 determines whether the low signal 180 received is at least the third (or other preselected number) consecutive low signal 180. If it is not, the process starts over again at initial step 184. If, however, this is at least the third consecutive low signal 180 received by the control circuit 100, then a determination is made as to whether power to the driver circuit 55 has been reduced by a preselected maximum allowable amount at step 188. If the power has not been reduced by the maximum allowable amount, power to the driver circuit 55 is reduced by 10%, or other preselected amount, at a step 190, the interrupt signal counter is reset at a step 192 and the process restarts at initial step 184. If, on the other hand, the power to the driver circuit 55 has been reduced by the maximum allowed amount, for example 20%, the power to the driver circuit 55 is shut down at a step 194.

It can be seen that the present invention utilizes the source voltage 80 of a compressor driver circuit 55 to detect piston overstroking 180, eliminating the need for installing intricate measuring devices and running commensurately complex software applications to process such measurements. The present invention also provides a current limiting circuit 132 that protects the armature windings 26 and the switches from a current surge that would otherwise be present when the source voltage 80 is shorted 180 to ground 82. In addition, the present invention permits a wider window of time to detect piston overstroking 180 by maintaining switch 86 on from beyond time $t_3$ to $t_3'$ (see FIG. 6). Although overstroking could occur and be detected prior to time $t_3$, the present invention permits overstroking to be sensed even after a time, $t_3$, when overstroking may occur due to a variety of situations that may result in non-ideal operating conditions.

Although the invention has been described with reference to a preferred embodiment illustrated in the attached drawings, it is noted that substitutions may be made and equivalents employed herein without departing from the scope of the invention as recited in the claims. For example, although the preferred embodiment is illustrated and described as a double-ended compressor assembly 10, it is to be understood that the invention is also applicable to single-ended compressors. In addition, although the compressor assembly 10 has been described and illustrated in conjunction with refrigerant system 17, the compressor assembly 10 can be used in a variety of other applications, including as clean air compressors in laboratory, medical, chemical or other applications. Another representative example in which compressor assembly 10 can be employed is as a pulse tube cooler or other machine requiring a pressure wave generator. In such an application, the valves 66 and 68 would normally be removed. It will thus be appreciated that the present invention is not limited to the particular applications in which compressor assembly 10 is used, but encompasses the method and apparatus for detecting and correcting overstroking of the pistons 18 utilized in the compressors 12 and 14.

While various embodiments and particular applications of this invention have been shown and described, it is apparent to those skilled in the art that many other modifications and applications of this invention are possible without departing from the inventive concepts herein. It is, therefore, to be understood that, within the scope of the appended claims, this invention may be practiced otherwise than as specifically described, and the invention is not to be restricted except in the spirit of the appended claims. Though some of the features of the invention may be claimed in dependency, each feature has merit if used independently.

Having thus described the invention, what is claimed is:

1. A method for correcting overstroking of a linearly oscillating piston in a grounded linear compressor driven by a supply voltage in a driver circuit, said piston oscillating at a varying stroke amplitude, said method comprising the steps of:

generating a signal by causing shorting of said supply voltage to a ground upon occurrence of said overstroking of the oscillating piston as it is being driven by said supply voltage; and reducing the stroke amplitude of said oscillating piston in response to said signal.

2. The method of claim 1, including reducing power to said driver circuit to cause said reduction in stroke amplitude of said oscillating piston.

3. The method of claim 2, wherein said step of generating a signal comprises varying a voltage level on an interrupt lead to a control circuit.

4. The method of claim 3, wherein said step of generating a signal comprises providing a low voltage level on said interrupt lead.

5. The method of claim 4, including the step of removing power from said driver circuit upon occurrence of said overstroking.

6. The method of claim 1, including the steps of monitoring a current flow through said driver circuit and opening the driver circuit when current above a preselected level flows through the driver circuit.

7. The method of claim 6, including comparing a voltage level produced in response to said current flow in said driver circuit to a preselected reference voltage and opening said driver circuit when said voltage level exceeds said reference voltage.

8. A linear compressor comprising:

a housing;

an armature positioned within the housing;

a piston mounted on the armature;

a barrel receiving said piston;

a driver circuit operatively coupled with said armature and operable to deliver a supply voltage to cause oscillating linear movement to the armature and piston at a variable stroke amplitude;

an interrupt contact coupled with said driver circuit and positioned to short said supply voltage to ground when said piston exceeds a desired stroke amplitude; and a control circuit having a lead operable to detect said short and operable to reduce power to said driver circuit upon detection of said short to reduce said stroke amplitude of the piston.

9. The linear compressor of claim 8, including an interrupt line connecting said interrupt contact to said control circuit.

10. The linear compressor of claim 8, wherein said barrel is grounded and said interrupt contact is positioned to contact said barrel when said piston exceeds said preselected stroke amplitude.

11. The linear compressor of claim 10, wherein said interrupt contact is positioned on said armature.

12. The linear compressor of claim 8, including a current limiting circuit associated with said driver circuit and operable to open said driver circuit when a current flow through said driver circuit exceeds a preselected level.

13. A linear compressor comprising:

a housing;

an armature positioned within the housing:

a piston mounted on the armature;

a driver circuit operatively coupled with said armature for delivering a supply voltage to cause oscillating linear movement of the armature and piston at a variable stroke amplitude;

an interrupt contact coupled with said driver circuit and positioned to short said supply voltage to ground when said piston exceeds a preselected stroke amplitude;

a control circuit having a lead for detecting said short and operable to reduce power to said driver circuit upon detection of said short to reduce said stroke amplitude of the piston; and a barrel that receives said piston, wherein said barrel is grounded and said interrupt contact is positioned to contact said barrel when said piston exceeds said preselected stroke amplitude.

14. The linear compressor of claim 13, wherein said interrupt contact is positioned on said armature.

15. A method for controlling linear oscillation of a piston in a grounded linear compressor, said method comprising the steps of:

driving said linear oscillation of said piston through a variable stroke amplitude using a supply voltage in a driver circuit;

generating a signal by causing shorting of said supply voltage to a ground upon each occurrence of overstroking of said stroke amplitude of said piston; and reducing said stroke amplitude of said linearly oscillating piston in response to a preselected number of said signals being generated.

16. The method of claim 15, including reducing power to said driver circuit to cause said reduction in stroke amplitude of said oscillating piston.

17. The method of claim 16, wherein said step of generating a signal comprises varying a voltage level on an interrupt lead to a control circuit.

18. The method of claim 17, wherein said step of generating a signal comprises providing a low voltage level on said interrupt lead.

19. The method of claim 18, including the step of removing power from said driver circuit upon occurrence of said overstroking.

20. The method of claim 15, including the steps of monitoring a current flow through said driver circuit and opening the driver circuit when current above a preselected level flows through the driver circuit.

21. The method of claim 20, including comparing a voltage level produced in response to said current flow in said driver circuit to a preselected reference voltage and opening said driver circuit when said voltage level exceeds said reference voltage.

22. The method of claim 15, wherein said step of reducing stroke amplitude occurs in response to at least three of said signals being generated.

* * * * *